US007669435B2

(12) United States Patent
Joshi

(10) Patent No.: US 7,669,435 B2
(45) **Date of Patent: *Mar. 2, 2010**

(54) MODULAR THERMOELECTRIC CHILLING SYSTEM

(75) Inventor: Anand Ganesh Joshi, Bangalore (IN)

(73) Assignee: General Electric Company, Niskayuna, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/734,287

(22) Filed: Apr. 12, 2007

(65) Prior Publication Data

US 2007/0175224 A1 Aug. 2, 2007

Related U.S. Application Data

(63) Continuation of application No. 10/737,951, filed on Dec. 15, 2003, now Pat. No. 7,216,490.

(51) Int. Cl.
*F25D 11/02* (2006.01)
*F25B 21/02* (2006.01)

(52) U.S. Cl. ..... 62/441; 62/3.6

(58) Field of Classification Search ..... 62/3.6, 62/3.2, 3.3, 441, 371, 457.1, 457.7, 457.9
See application file for complete search history.

(56) References Cited

U.S. PATENT DOCUMENTS 3,209,547 A * 10/1965 Elfving ..... 62/3.6
4,727,720 A * 3/1988 Wernicki ..... 62/3.63
5,642,628 A 7/1997 Whipple, III et al.
6,050,097 A 4/2000 Nelson et al.
6,148,624 A 11/2000 Bishop et al.
6,412,286 B1 * 7/2002 Park et al. ..... 62/3.6
6,481,216 B2 11/2002 Simmons et al.
7,216,490 B2 * 5/2007 Joshi ..... 62/3.6
2002/0121096 A1 9/2002 Harrison et al.

* cited by examiner

*Primary Examiner*—Chen-Wen Jiang
(74) *Attorney, Agent, or Firm*—Penny A. Clarke

(57) ABSTRACT

In an aspect of the invention, an apparatus for providing chilling in a localized area comprises a chiller compartment and an independent cooling source thermally coupled to the chiller compartment by a thermally conductive interface. The cooling source provides a separate controllable temperature to the chiller compartment, which is adapted to be removably positioned in a selected temperature controlled environment. In another aspect a refrigerator comprises a freezer unit, a fresh food unit and a chiller compartment adapted to be removably positioned in either the freezer unit or the fresh food unit as a secondary chilling compartment. In another aspect a method of chilling comprises cooling a modular chiller compartment using an independent cooling source, chiller compartment being removably positioned within a temperature controlled environment and the cooling source and the chiller compartment being thermally coupled.

19 Claims, 2 Drawing Sheets

MODULAR THERMOELECTRIC CHILLING SYSTEM

CROSS-REFERENCE TO RELATED APPLICATIONS

This Application is a CONTINUATION of U.S. patent application Ser. No. 10/737,951, filed Dec. 15, 2003, now U.S. Pat. No. 7,216,490.

BACKGROUND OF THE INVENTION

The present invention relates generally to refrigeration systems and methods, and more specifically to providing a modular or localized chiller compartment that is removable in selectable environments.

Refrigerators are among the most conventionally known appliances for cooling food items. Features providing convenience are important for consumers of refrigerators. For example, for ice making, today's customers demand ice delivered conveniently, at a location within the refrigerator preferable for them, while keeping the chilling time as minimal as possible. Thus, having the ability to make ice in a more convenient and faster way would be a big convenience. However, known attempts for making ice in a compartment separate from the main freezer unit of a refrigerator, such as portable refrigeration units, enjoy limited success due to their heavy weight and large size.

Various technology factors and customer preferences dictate positioning of functional units such as ice storage units, fresh food units in the refrigerator. For example, in Bottom Mount Freezer (BMF) type refrigerators, having freezer units below fresh food units is a customer preference, since cold stored foods are less frequently used as compared to foods stored in fresh food units. However, a problem arises for accessing ice, which may be frequently required, but is made in the freezer unit. Thus it is inconvenient to access ice frequently in a bottom mount freezer, since the freezer unit is located at the lowest level in the BMF type refrigerators. Accordingly, customer preference requires ice to be dispensed at a suitable height, much above the freezer unit. Contemporary attempts at providing ice at a preferred height include methods that require transporting ice from the freezer unit to the fresh food unit. Such methods are cumbersome to implement and add a lot of unnecessary equipment, adding to the cost and complexity of the whole system Such and other solutions have been tried with limited success, and in general it is desirable to have simpler methods and systems for providing ice at a convenient location in a refrigerator. Similarly, for other known models of refrigerators, such as Side-by-Side and Top Mount Freezer type refrigerators, there may a customer preference to have a separate chiller unit for additional ice-making capability, and accordingly there exists a need for such an additional ice making method and system.

In general, it is desirable to have independent systems and methods for making ice that are simple to use and position in a convenient location of the existing refrigerators or generally can be placed in any environment. Thus, it will be advantageous and convenient to have modular methods and systems for making ice anywhere that are also capable of making ice in a suitable environment.

BRIEF SUMMARY OF THE INVENTION

According to one embodiment an apparatus for providing chilling in a localized area comprises at least one chiller compartment and an independent cooling source thermally coupled to the chiller compartment by a thermally conductive interface. The cooling source provides the chiller compartment a separate controllable temperature. The chiller compartment is adapted to be removably positioned in a selected temperature controlled environment.

According to another embodiment a refrigerator comprises at least one freezer unit, at least one fresh food unit and at least one chiller compartment adapted to be removably positioned in either the freezer unit or the least one fresh food unit as a secondary chilling compartment.

According to another embodiment a method of chilling comprises cooling a modular chiller compartment using an independent cooling source. The chiller compartment is removably positioned coupled within at least one temperature controlled environment and the cooling source and the chiller compartment are thermally coupled.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
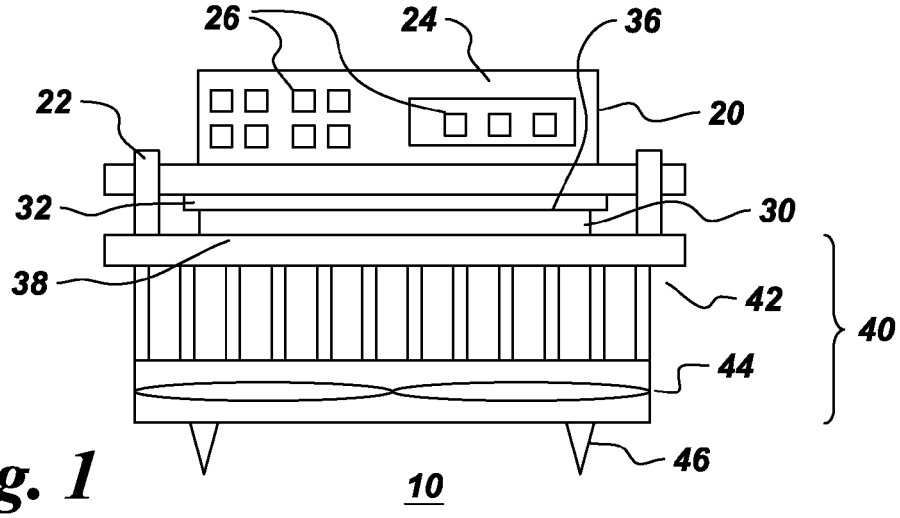
FIG. 1 is a front elevational cross section view of an apparatus for providing chilling, according to an embodiment.

Referring now to FIG. 1, an apparatus 10 for providing chilling is shown, according to an embodiment of the present invention. In this implementation, at least one modular chiller compartment 20 is thermally coupled to a cooling source 30, by a thermally conductive interface 32. The cooling source 30 is an independent modular cooling device and provides cooling to the chiller compartment 20, which defines a localized area for providing chilling. The chiller compartment 20 is configured to house container devices and food items such as ice trays or meat portions, among others. In certain embodiments, the chiller compartment 20 may be advantageously configured as an ice tray. The thermally conductive interface 32 such as an intermediate metal retainer, for example, is positioned between the chiller compartment 20 and the cooling source 30, and may at least partially cover the source 30. The interface 32 may additionally be configured to enable a safe replacement of the chiller compartment 20, by avoiding exposure of the cooling source 30 when the chiller compartment 20 is removed. The cooling source 30 provides cooling (or 'low temperature', hereinafter used interchangeably with 'cooling' or 'cooling effect') to the interface 32, which provides the cooling to the chiller compartment 20, thereby providing a low temperature within the chiller compartment 20, to enable chilling. In this embodiment, it is appreciated that direct contact between the chiller compartment 20 and the cooling source 30 provides an interface that is thermally conductive. It will be further appreciated that the term "ice" is generally used to refer to frozen material, and is not meant to be restrictive to frozen water. Throughout the discussion "ice" and "frozen material" have been used interchangeably.

As used herein, "adapted to", "configured" and the like refer to mechanical or structural connections between elements to allow the elements to cooperate to provide a described effect; these terms also refer to operation capabilities of electrical elements such as analog or digital computers or application specific devices (such as an application specific integrated circuit (ASIC)) that are programmed to perform a sequel to provide an output in response to given input signals.

The chiller compartment 20 is adapted to be removably positioned in temperature controlled environments, such as inside refrigerators, for example side-by-side, top mounted, bottom mounted, single door refrigerators, among others. More specifically, the chiller compartment 20 may be removably positioned inside a fresh food unit or a freezer unit of the refrigerators, as discussed above. According to another embodiment, the chiller compartment 20 is adapted to be removably positioned in an ambient environment or environments without temperature control. Ambient environment generally refers to control volumes that are thermally open to the atmosphere, and includes, for example, rooms of a house or lawns. A positioning device 46 is advantageously configured to provide a stable and a removable positioning to the apparatus 10 in such environments. For example, the positioning device 46 may comprise of adjustable screw mounts as shown in the figure. Alternately, the positioning device 46 may be a customized casing for housing the apparatus 10, and having an attach profile configured to match that of a refrigerator unit (fresh food or freezer), enabling the apparatus carrying casing to be detachably positioned in the refrigerator.

It is appreciated here that refrigerators typically comprise a refrigerant-based closed loop cooling system, which provides cooling to freezer unit and fresh food unit of the refrigerator. The terms 'cooling source' 30 and 'chiller compartment' 20 in the present discussion are distinct from the cooling system and freezer unit of the refrigerator.

The cooling source 30 may be an independent cooling device such as a thermoelectric coupled cooling device, which is a solid state cooling device based on Peltier effect. Thermoelectric coupled cooling devices typically use temperature gradient associated with a provided electric potential gradient. For example, in the present embodiment, the cooling source 30 may be a set of thermoelectric coupled modules (not shown). On application of an electric potential (or voltage) one of the two junctions of the couple modules becomes low in temperature and absorbs heat, while the other junction heats up, dissipating heat. The junction absorbing heat can be used for cooling purposes, such as making ice, for example, among others as discussed and included within the scope of present discussion. On application of a reverse polarity voltage, the thermal profile of the junctions is also reversed.

It is appreciated here that though the embodiments will be described with reference to a thermoelectric cooling source as discussed above, other cooling devices may also be used as a cooling source. In such cases, the cooling source 30 may be further configured to adapt to the apparatus 10, as required.

If required, a device for transferring heat generated by the cooling source 30, such as a heat exchanger 40, is thermally coupled to the cooling source 30. A heat exchanger 40 typically comprises a heat sink 42 for absorbing heat and preferably spreading heat over a large surface area and a fan 44 for circulating air over the heat sink 42, thereby transferring the heat to the air and directing the heat carrying air out from the system the heat exchanger 40 is placed in. The cooling source 30 may be directly coupled to heat exchanger 40 at the heat sink 42 (as shown in the figure) or may use a thermal interface (not shown), such as a protective metallic plate. The chiller compartment 20 is secured to the cooling device 30 (or the interface 32) by an attach device 22. The attach devices 22 such as flexi clamps, for example, are configured to hold the chiller compartment 20 in a stable position over the cooling source 30. As shown in the figure, the attach devices 22 may be advantageously anchored to the heat sink 42. In other examples, a separate base plate (not shown) may be positioned between the cooling device 30 and the heat exchanger 40 for providing anchor to the attach devices 22. In certain embodiments, the chiller compartment 20 may not be positioned in physical proximity to the cooling source 30. In such embodiments, the attach devices 22 are configured to hold the chiller compartment 20 over the thermally conductive interface 32 and the thermally conductive interface 32 provides thermal coupling between the cooling source 30 and the chiller compartment 20.

According to an embodiment, the chiller compartment 20 may house ice tray 24 having ice cavities 26 for making ice in different shapes such as cube, sphere, cones, fish, animal shapes, for example, among many other possibilities. The ice tray 24 is removable to allow for replacement with other similar ice trays 24 having selectable shapes. According to a yet another embodiment, the chiller compartment 20, having selectable shaped ice cavities 26, may be configured as an ice tray 24. In such implementations, the chiller compartment 20 is removed and replaced by similar chiller compartments, having selectable shaped ice cavities 26. Operationally, the cooling source 30 is cold at a top side 36 of the cooling source 30 and hot at a bottom side 38 of the cooling source 30, corresponding to an applied electric potential, hereinafter referred to as a forward potential. In this configuration, the cold top side 36 is towards the interface 32 to provide cooling to the chiller compartment 20, while the hot bottom side 38 is towards the heat sink 42, to enable the heat to be removed by the heat exchanger 40. Accordingly the chiller compartment 20 is cooled and suited to make ice in this configuration (also referred to as the 'ice making configuration'. An opposite configuration of the cooling device 30 is achieved by applying a reverse electric potential, opposite in polarity to the forward potential. The applied reverse potential may have a different or same magnitude as the forward potential. In this opposite configuration a reversal in the temperatures of the sides occurs so that the top side 36 becomes hot, while the bottom side 38 becomes cold. The hot top side 36 causes a temperature rise in the chiller compartment 20, thereby increasing the temperature of the ice tray 24 therein. The reverse potential may be applied for intervals of time sufficient to release ice from the ice cavities 26. The increased temperature provided in the chiller compartment melts the water uniformly at the interface of frozen ice with the ice cavity 26, this uniform melting advantageously allows for obtaining complicated shaped ice, such as a fish shape, to be removed intact from the ice cavity 26. This configuration, in which the reverse potential is applied for a short interval sufficient to release ice, is referred to as 'ice removal configuration'. Further, the cold bottom side 38 is now in thermal contact with the heat exchanger 40, and accordingly, the heat exchanger 40 fans out cold air and is discussed with reference to FIG. 2. It will be appreciated here that 'top' and 'bottom' terminology has been used with reference to FIG. 1 and is merely indicative of the position in the figure, and not meant to be restrictive on the implementation of the embodiment.

Figure 2:
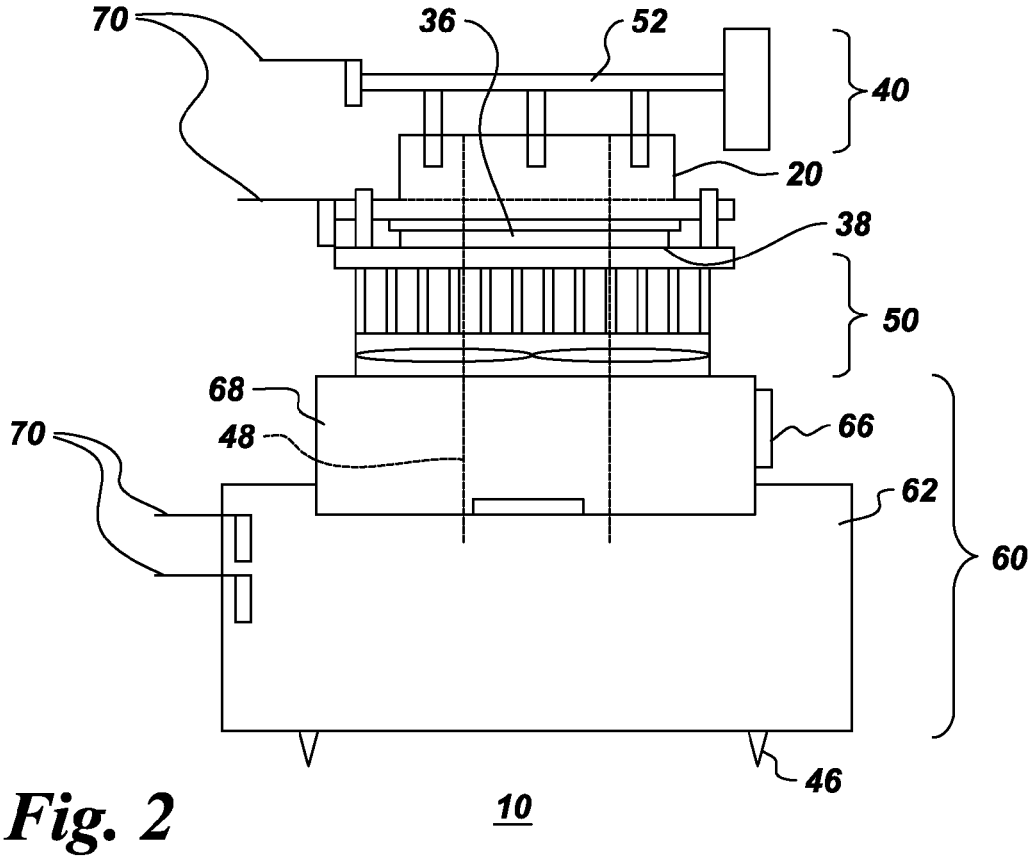
FIG. 2 is a front elevational cross section view of an apparatus for providing chilling, according to another embodiment.

FIG. 2 shows the apparatus 10 according to another embodiment. An ice removal mechanism 50 is coupled to the chiller compartment 20 and is configured or adapted to remove ice from the chiller compartment 20. In an exemplary embodiment shown in FIG. 2, for example, the ice removal mechanism 50 comprises an ice removing arm 52 configured to remove the ice from the chiller compartment 20 by scooping the ice or by tilting the chiller compartment 20. An ice conveying channel 48 (shown in phantom) is provided for conveying ice, removed by the ice removal mechanism 50, for storage or dispensing. It is appreciated that ice removal mechanisms are well known in the art, and such known or new ice removal mechanisms may be adapted and utilized to remove ice from the chiller compartment 20, without altering the scope of the invention. A heat exchanger 40 may be provided for removing the heat generated by the cooling source 30, as discussed above.

The apparatus 10 of FIG. 2 further comprises an ice preservation mechanism 60 for storing and preserving ice generated in the chiller compartment 20. According to the exemplary embodiment illustrated by FIG. 2, the ice preservation mechanism 60 comprises an insulated ice storage box 62 for storing ice, at least two dampers 64, 66 and a damper arrangement 68 configured to direct cold air from the cooling source 30 to the ice storage box 62. As discussed, in the ice making configuration, the top side 36 is cold to provide cooling to the chiller compartment 20 and the bottom side 38 is hot to enable heat removal by the heat exchanger 40. The dampers 64, 66 and the damper arrangement 68 are configured to block any flow of hot air generated by the heat exchanger 40 into the ice storage box 62. Ice generated in the chiller compartment 20 and removed by the ice removal mechanism 50 may be stored in the ice storage box 62. To preserve the stored ice, a sufficiently low temperature is required to be maintained in the ice storage box 62. Accordingly, a reverse potential is applied for a longer time duration than in the ice removal configuration, and this configuration is referred to as 'ice storage configuration' and in this configuration the bottom side 38 becomes cold and the heat exchanger 40 coupled to the cooling source 30 on its bottom side 38 fans out cold air for a longer time. The dampers 64, 66 and the damper arrangement 68 advantageously reconfigure to direct this cold air from the heat exchanger 40 to the ice storage box 62, while in ice removal or ice storage configurations. The ice storage configuration may be employed when ice is required to be stored in the ice storage box 62. The configurations may be toggled between the ice making, ice removal and ice storage states as needed by a user of the apparatus 10.

In related embodiments, a control device (not shown) such as a programmable circuit chip, for example may regulate the operation of the apparatus 10. Typically such circuit chips may comprise ports for obtaining data including system parameters such as temperature of various compartments, ice level, configuration of ice removal mechanism 50 among others; a memory for storing such data; and a processor for processing such data to provide regulate and control the various components of the apparatus 10. Sensing devices 70, for sensing parameters such as temperature, ice level, ice removal mechanism configuration, for example temperature sensors, may be provided at various positions in the apparatus as indicated in the figure. The control device, as discussed, may also regulate the operation of the apparatus 10 on a time basis, among various other possible criterions. For example, the control device regulates the damper arrangement 68 and the dampers 64, 66 to prevent heat from the heat exchanger 40 from being directed to the ice storage box 62, in the ice making configuration. In the ice removal and ice storage configurations, the control device regulates the cooling source 30 by applying a reverse potential and thereby causing a uniform heating of the ice cavities 26 in the ice tray 24 to loosen ice. The control device may activate the ice removal mechanism 50 to remove the loosened ice to the ice storage box 62. In the ice storage configuration, the control device further regulates the damper arrangement 68 and the dampers 64, 66 to direct the cold air from the heat exchanger 40 to the ice storage box 62, to maintain sufficiently cold temperature and time duration to preserve ice. The control device may be configured to toggle the configuration from ice making to ice storage based on parameters such as, for example, ice level in the ice storage box 62 or temperatures inside the ice storage box 62 or the ice tray 24. As discussed, such parameters may be measured using sensing devices 70.

The embodiment illustrated by FIG. 2 may be positioned using the positioning device 46 in environments including, but not limited to, sections of refrigerators such as freezer unit or fresh food unit, chiller units provided in a car, ambient environment such as kitchen, among others.

Figure 3:
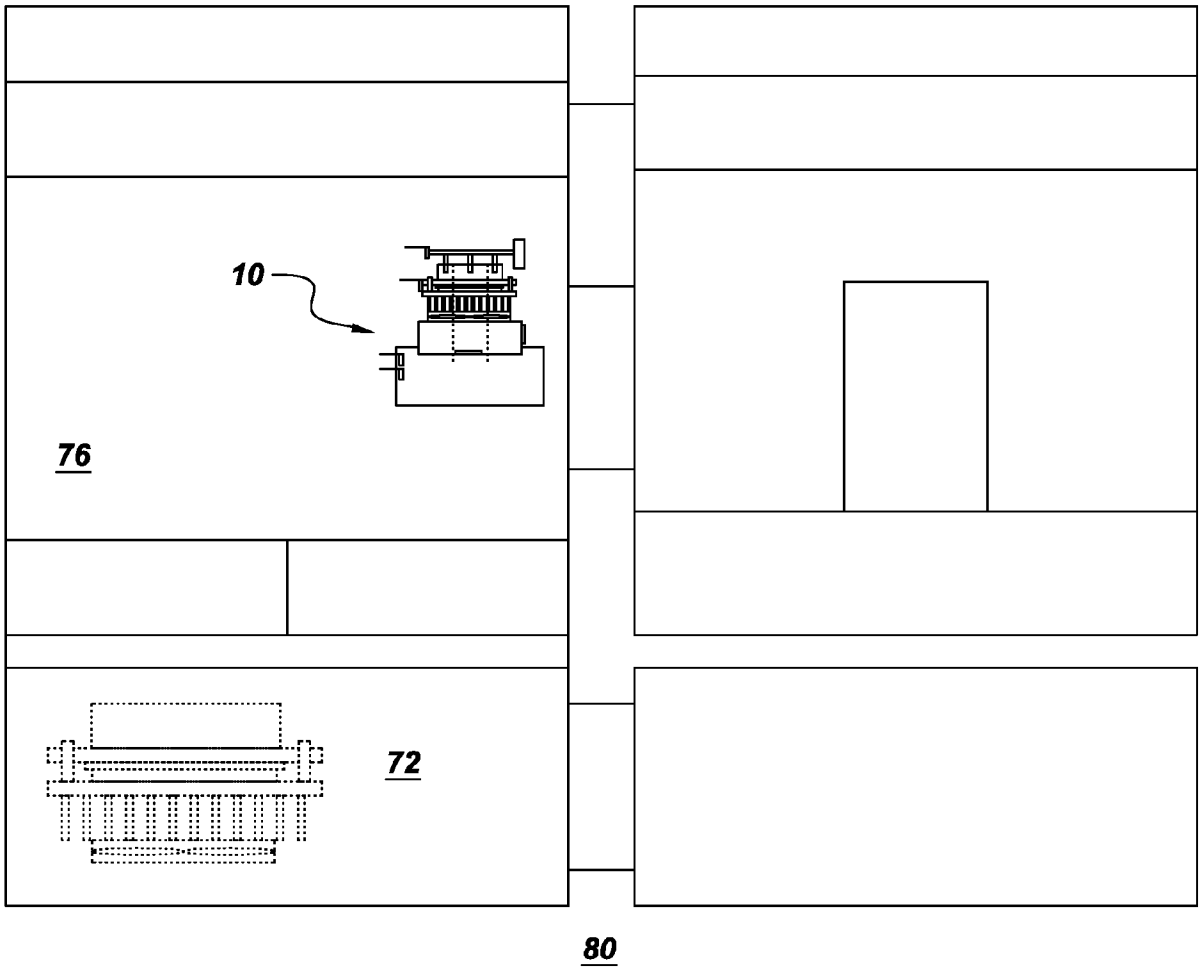
FIG. 3 is a front elevational view of a refrigerator according to an embodiment.

According to another embodiment, a refrigerator 80 is illustrated in FIG. 3. The refrigerator 80 comprises at least one freezer unit 72 and at least one fresh food unit 76. At least one chiller compartment 20 is adapted to be removably positioned in either the at least one freezer unit 72 or the at least one fresh food unit 76 as a secondary chilling compartment. An independent cooling source 30 is thermally coupled to the at least one chiller compartment 20 by a thermally conductive interface 32, such as an intermediate metal retainer, for providing the chiller compartment 20 a separate controllable temperature. The cooling source 30 is an independent source of cooling, such as a thermoelectric coupled cooling unit, as discussed earlier with respect to FIGS. 1 and 2. A heat exchanger 40, if required, may be thermally coupled to the cooling source 30 to remove heat from the cooling source 30.

An attach device 22, for example clamps, which are well known, is configured to removably attach and position the at least one chiller compartment 20 to the cooling source 30 or the thermally conductive interface 32. At least one ice cavity tray 24, having a plurality of ice cavities 26 configured to provide ice in selectable shapes, is configured to be removably positioned in the chiller compartment 20, so that a user may replace the ice tray 24 with a similar ice tray having similar or different shaped ice cavities. In some embodiments, the chiller compartment 20 is configured as a replaceable ice tray 24.

According to another embodiment the refrigerator 80 further comprises and ice removal mechanism 50 configured to remove ice from the chiller compartment 20. In one of the contemplated implementations, the ice removal mechanism 50 also uses thermoelectric heating of the ice cavity tray 24 to loosen ice from the ice cavities 26. Once the ice is loosened, the ice removal mechanism 50 may tilt the ice cavity tray 24 to remove ice from the ice cavities 26.

The refrigerator 80 further comprises an ice preservation mechanism 60 comprising an ice storage box 62 configured to receive ice from the chiller compartment 20. The ice preservation mechanism 60 is configured to direct cooling from the cooling source 30 to the ice storage box 62, and more specifically, the ice preservation mechanism 60 comprises dampers 64, 66 and a damper arrangement 68 adapted to direct cooling from the cooling source 30 to the ice storage box 62, in the ice storage configuration. A positioning device 46 is adapted to stably position at least one of the chiller compartment 20 and the cooling source 30 in the refrigerator 80. For example, as shown in FIG. 3, an arrangement of the chiller compartment 20 and the cooling source 30, similar to the embodiment illustrated by FIG. 2, is positioned in the fresh food unit 76 of the refrigerator 80. In other cases, an arrangement of the chiller compartment 20 and the cooling source 30, similar to the embodiment of FIG. 1, may be positioned in the freezer unit 72 of the refrigerator 80 (shown in phantom), and the positioning device 46 may be suitably adapted to stably position various such arrangements.

Other features, such as a control device of the refrigerator 80, auto water feed system for automatic sensing and supplying water to the ice tray / chiller compartment, sensing mechanisms may be advantageously combined with the above embodiment.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An apparatus for providing chilling in a localized area of a temperature controlled environment comprising:

at least one chiller compartment;

an independent cooling source thermally coupled to the at least one chiller compartment by a thermally conductive interface for providing the chiller compartment a separate controllable temperature;

a plurality of ice cavities coupled to the thermally conductive interface and configured to provide ice;

an ice preservation mechanism comprising an ice storage box configured to receive ice from the chiller compartment, wherein the ice preservation mechanism is configured to direct cooling from the cooling source to the ice storage box, and wherein the at least one chiller compartment is adapted to be removably positioned within a sub-compartment of the temperature controlled environment.

2. The apparatus of claim 1, wherein the apparatus further comprises an attach device configured to removably attach and position the at least one chiller compartment to at least one of the cooling source or the thermally conductive interface.

3. The apparatus of claim 1, wherein the temperature controlled environment is a refrigerator, and wherein the refrigerator is selected from the set of a side-by-side, top mounted, bottom mounted, single door refrigerator.

4. The apparatus of claim 3, wherein the sub-compartment of the temperature controlled environment is a freezer unit of the refrigerator.

5. The apparatus of claim 3, wherein the sub-compartment of the temperature controlled environment is a fresh food unit of the refrigerator.

6. The apparatus of claim 1, further comprising a positioning device for stably positioning the apparatus in the sub-compartment of the temperature controlled environment.

7. The apparatus of claim 1, wherein the chiller compartment is further adapted to be removably positioned in an ambient environment.

8. The apparatus of claim 1, further comprising a heat exchanger thermally coupled to the cooling source.

9. The apparatus of claim 1, wherein the cooling source is a thermoelectric unit.

10. The apparatus of claim 1, further comprising an ice removal mechanism.

11. The apparatus of claim 10, wherein the ice removal mechanism uses thermoelectric heating of the ice cavities to loosen ice from the ice cavities.

12. The apparatus of claim 10, wherein the ice removal mechanism tilts the ice cavities to remove ice from the ice cavities.

13. The apparatus of claim 1, wherein the ice preservation mechanism further comprises a damper arrangement having a plurality of dampers, configured to direct cooling from the cooling source to the ice storage box or direct heating away from the ice storage box.

14. A refrigerator comprising:

at least one freezer unit;

at least one fresh food unit;

at least one chiller compartment adapted to be removably positioned in either the at least one freezer unit or the at least one fresh food unit as a secondary chilling compartment;

an independent cooling source thermally coupled to the at least one chiller compartment by a thermally conductive interface;

a plurality of ice cavities coupled to the thermally conductive interface and configured to provide ices; and an ice preservation mechanism comprising an ice storage box configured to receive ice from the chiller compartment, wherein the ice preservation mechanism is configured to direct cooling from the cooling source to the ice storage box.

15. The refrigerator of claim 14, further comprising a heat exchanger thermally coupled to the cooling source.

16. The refrigerator of claim 14, wherein the cooling source is a thermoelectric unit.

17. The refrigerator of claim 14, further comprising an ice removal mechanism for harvesting ice.

18. The refrigerator of claim 14, wherein the ice removal mechanism uses thermoelectric heating of the ice cavities to loosen ice from the ice cavities.

19. A refrigerator comprising:

a freezer unit;

a fresh food unit;

a chiller compartment adapted to be removably positioned in either the at freezer unit or the fresh food unit as a secondary chilling compartment;

a thermoelectric cooling source thermally coupled to the chiller compartment by a thermally conductive interface;

a plurality of ice cavities coupled to the thermally conductive interface and configured to provide ices; and an ice preservation mechanism comprising an ice storage box configured to receive ice from the chiller compartment, and wherein the ice preservation mechanism is configured to direct cooling from the cooling source to the ice storage box.

* * * * *

UNITED STATES PATENT AND TRADEMARK OFFICE

CERTIFICATE OF CORRECTION

PATENT NO. : 7,669,435 B2
APPLICATION NO. : 11/734287
DATED : March 2, 2010
INVENTOR(S) : Joshi It is certified that error appears in the above-identified patent and that said Letters Patent is hereby corrected as shown below:

In Column 1, Line 46, delete "system" and insert -- system. --, therefor.

In Column 8, Line 25, in Claim 14, delete "ices;" and insert -- ice; --, therefor.

In Column 8, Line 44, in Claim 19, delete "the at" and insert -- the --, therefor.

In Column 8, Line 50, in Claim 19, delete "ices;" and insert -- ice; --, therefor.

Signed and Sealed this

Twenty-third Day of November, 2010

David J. Kappos

David J. Kappos
*Director of the United States Patent and Trademark Office*